United States Patent [19]

Tolliver

[11] 4,452,026

[45] Jun. 5, 1984

[54] SPACER FOR WIRE REINFORCEMENT IN CONCRETE STRUCTURES SUCH AS PIPE

[76] Inventor: Wilbur E. Tolliver, 364 Hamilton Dr., Holland, Mich. 49423

[21] Appl. No.: 305,969

[22] Filed: Sep. 28, 1981

[51] Int. Cl.[3] ..... E04C 5/16

[52] U.S. Cl. ..... 52/684; 52/687

[58] Field of Search ..... 52/684, 685, 686, 677, 52/712, 687

[56] References Cited

U.S. PATENT DOCUMENTS

| | | | |
|---|---|---|---|
| 1,750,286 | 3/1930 | Sherwan . | |
| 3,172,239 | 3/1965 | Larkin | 50/507 |
| 3,440,792 | 4/1969 | Schmidgall | 52/687 |
| 3,471,986 | 10/1969 | Swenson | 52/652 |
| 3,512,330 | 5/1970 | Shlesinger | 52/687 |
| 3,722,164 | 3/1973 | Schmidgall | 52/684 |
| 3,861,096 | 1/1975 | Emmons | 52/98 |
| 4,301,638 | 11/1981 | Schmidgall | 52/687 |

FOREIGN PATENT DOCUMENTS

| | | | |
|---|---|---|---|
| 1007983 | 1/1955 | Fed. Rep. of Germany . | |
| 2109183 | 9/1972 | Fed. Rep. of Germany | 52/677 |
| 2126981 | 5/1973 | Fed. Rep. of Germany | 52/685 |
| 723879 | 1/1932 | France | 52/686 |
| 579223 | 7/1946 | United Kingdom | 52/684 |

OTHER PUBLICATIONS

Spacers for Reinforced Concrete Pipe, CMC, Blue Ridge Rubber Co., 1976, (price list).

*Primary Examiner*—J. Karl Bell

*Attorney, Agent, or Firm*—Price, Heneveld, Huizenga & Cooper

[57] ABSTRACT

An apparatus, method and assembly are disclosed for spacing a wire reinforcement from a concrete article form such as pipe form. Spacers are employed which include a U-shaped spacer portion extending from a mounting means which includes a positioning means, a torsion means, and arms extending therefrom to hook about a wire in said fabric and be held thereto substantially by the torsion generated within the torsion means. The reinforcement spacers are mounted at spaced points on a pipe reinforcing cage, for example, around the circumference and along the length of the cage so that each spacer portion extends radially outwardly therefrom the hold the cage in properly spaced relationship to the pipe form.

49 Claims, 15 Drawing Figures

SPACER FOR WIRE REINFORCEMENT IN CONCRETE STRUCTURES SUCH AS PIPE

BACKGROUND OF THE INVENTION

The present invention relates to a spacer for wire reinforcement used in the manufacture of welded wire reinforced concrete articles such as pipe; and more specifically to such a spacer for spacing the welded wire reinforcement from the pipe form during the operation when concrete is formed around the wire reinforcement.

A wire reinforcing assembly typically comprises wire fabric generally conforming to the shape of the article being formed. For example, in manufacturing a wire reinforced concrete pipe, the fabric is shaped into a generally cylindrical cage of a smaller diameter than the cylindrical pipe form in which the pipe is to be cast. The cage assembly usually has a plurality of parallel longitudinal (or transverse) wires running lengthwise thereof and a plurality of generally circumferential parallel wires joined to the longitudinal wires.

In the manufacture of a wire reinforced concrete pipe, it is essential that the cage assembly is located in the pipe form a spaced distance from the pipe form wall, regardless of the type of pipe form used. When a single external wall form is used and the pipe is formed in a packer head machine, the wire cage must be spaced from the external wall. When a double wall form is utilized and the concrete is to be cast around the cage, the cage assembly must be spaced from both the inner and outer walls. Various spacing devices exist in the prior art for performing these functions but none have been completely satisfactory.

Often, short steel rods are welded or otherwise secured to the reinforcing cage to serve as spacers. These rods must be positioned along the length and around the circumference of the cage. It is extremely time-consuming to weld these spacers to the cage assembly. In addition, the unfinished rod ends which engage the pipe form scratch or otherwise score the form, destroying its smooth surface. Further, these single leg rods can be bent when the cage is inserted into a form, which destroys the desired accurate spacing between the cage and pipe form.

Other prior art devices are shown in FIGS. 6, 7, and 8. FIG. 6 discloses a two-legged C-shaped spacer 50 which is mounted on the reinforcing fabric by hooking legs 51 and 52 over one circumferential wire B and abutting segment 53 against another circumferential wire A. Sometimes, this spacer is welded in place to prevent it from falling off of the reinforcing fabric, and consequently its assembly requires a great deal of time. Furthermore, this C-shaped spacer cannot be placed on transverse wires C because such wires are generally spaced too far apart. A variation on spacer 50 is 50*a* in FIG. 6*a*. Here, segment 53*a* is hooked over circumferential wire A.

Another prior art spacer is the band steel clip 60, shown in FIG. 7, formed from spring steel. The band steel clip is installed by hooking upper hook 61 over a circumferential wire A and snapping lower hook 62 onto the second circumferential wire D so that leg 63 abuts the intermediate circumferential wire B. The offset projection 64 extends outwardly from the wire fabric to form a spacer element that spaces the cage from the pipe form. This device has significant drawbacks. First, the spacing between circumferential wires must be extremely consistent or the band clips will not clip onto the wires. Second, the clips can be knocked off when putting the form or cage assembly in place. Vibration from the packer head may also knock the clip off during the packing operation. Finally, a different size clip is required for different fabrics having different circumferential wire spacing and/or wire gauge.

Another prior art device is the spring steel wire spacer 70, shown in FIG. 8, and U.S. Pat. No. 3,722,614 issued Mar. 27, 1973, to Schmidgall. The spring steel spacer is installed by hooking spacing hook 71 around the intersection of a longitudinal wire C and a circumferential wire A, pushing spring arm 73 towards the longitudinal wire, and hooking retaining hook 74 around the longitudinal wire. In this position, a spacing prong 72 projects upwardly from spacing hook 71. Although this spring steel spacer will work regardless of the spacing between the circumferential wires, it does have other serious drawbacks. First, spacing prong 72 has an unfinished end which can score or otherwise mar the pipe form. Second, because spring force is utilized, this device must be made out of spring steel in order to obtain the required force between the two hooked ends. This material is relatively expensive and consequently makes the spacer expensive. Third, this device is somewhat hazardous to use because the spacer is prone to cut one's hand during installation while pushing the spring arm 73 around. Fourth, because of its complicated twisted construction, this hook is difficult to install. Indeed, it is difficult to remember how to install it. Finally, the pipe form can hit and bend the single spacing leg and thereby destroy the desired spacing between the reinforcing fabric and the concrete form.

Plastic spacers have also previously been used. However, these spacers are expensive, break easily, and fall off of the reinforcing fabric easily.

SUMMARY OF THE INVENTION

In the present invention, these problems are solved by employing a spacer whose operation is based upon torsional action, as well as bending spring action. The spacer of the present invention comprises mounting means for mounting the spacer to the wire fabric, with the mounting means including torsion means. A spacer portion extends away from the mounting means in order to space the fabric from an adjacent form. Torsional force generating means are operably connected to the torsion means for engaging the reinforcement and for generating a torsion holding force in the torsion means to thereby assist in holding the spacer on the wire fabric. More specifically, the torsional force generating means are adapted to engage opposite sides of the fabric whereby the spacer is clamped onto the fabric by said torsion means acting on said torsional force generating means.

Because the spacer utilizes torsional force rather than spring level force to retain itself on the fabric, spring steel construction is unnecessary. Therefore, a relatively inexpensive steel or equivalent material may be used, lowering the cost of the spacers. Because the clip arms engage a single wire, spacing between the wires, both circumferential and longitudinal, is not crucial and may vary without affecting the mountability of the spacer, so long as torsion leg 34 is sufficiently long. The spacer projection is not easily bent because it is a double element, being U-shaped, and not merely a single leg.

Furthermore, the U-shaped spacer projection will not mar or gouge the pipe form. The reinforcement spacer is extremely simple to use, being attached by hooking it onto a single wire with torsion leg 34 extending over an adjacent wire and securing the clip arms on opposite sides of a single laterally oriented wire.

These and other objects, advantages, and features of the invention will be more fully understood and appreciated by reference to the written specification and appended drawings.

DESCRIPTION OF THE PREFERRED EMBODIMENT

Figure 1:
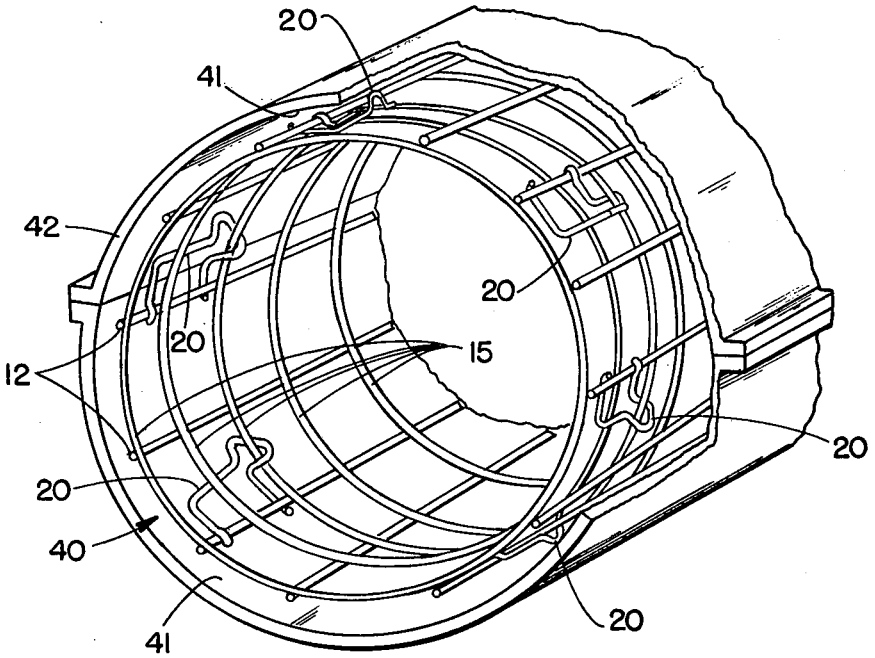
FIG. 1 is a perspective view of a wire reinforcing cage with the reinforcement spacers installed thereon inserted within a concrete form of the single external wall type.
Figure 6A:
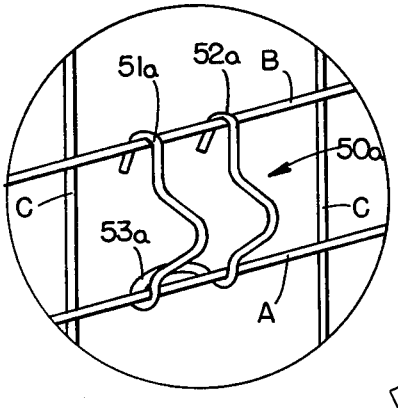
FIG. 6a (PRIOR ART)
FIG. 6*a* is a perspective view of a similar prior art reinforcement spacer.

Referring to the drawings, FIG. 1 discloses my invention of a spacer utilized in a conventional environment for constructing a reinforced concrete pipe. In FIG. 1, reference numeral 42 designates a single external, form 42 utilized in construction of the concrete pipe by use of a packer head machine. In the use of this single, external, wall-type form, the concrete is packed by the packerhead on the inside wall 41 of the form 42.

FIG. 1 discloses form 42 with the cage or fabric assembly 40 mounted inside in position spaced from the inner wall 41 so that when the concrete is packed against the inner wall 41, the concrete will be packed around the cage so as to form a reinforced concrete pipe. Such pipe is later removed from the form by separation of the two sections 42*a* and 42*b*.

Cage 40, as shown in FIG. 1, is formed by forming wire fabric comprised of longitudinal or transverse wires 12 and circumferential wires 15 into a cylindrical configuration. As shown, longitudinals 12 are on the outside of circumferentials 15, but it will be understood that spacer 20 of the present invention would work equally well if longitudinals 12 were on the inside. A plurality of reinforcement spacers 20 are mounted on cage 40 along both its length and circumference.

Each spacer 20 comprises an upstanding spacer portion 29 which serves to space the reinforcement 40 from form 42. Extending in one direction therefrom is a torsion bar 34. Extending in the opposite direction is a wire engaging or positioning portion 25. Then extending generally perpendicularly from the plane of these three portions are a pair of clip arms 22 and 36, one extending from wire engaging portion 25 and the other from the end of torsion bar 34. When these clip arms are hooked over wires in reinforcement 40, torsional and bending forces are generated in torsion bar 34 and to some degree throughout spacer 20 to cause it to be securely clipped to reinforcement 40.

As shown in FIG. 1, spacers 20 are positioned on circumferential wires 15 with their torsional force generating clip arms 22 and 36 hooked over opposite sides of a longitudinal wire 12. If the longitudinal wires were sufficiently close together, spacers 20 could be oriented 90°. However, longitudinals are normally six inches or more apart, whereas circumferentials are normally about two, three or four inches apart. Hence, in order to orient spacers 20 90° from the orientation shown in FIG. 1, one would have to make spacers 20 with rather long torsion bar portions 34, as will be more fully understood from the following explanation.

Figure 2:
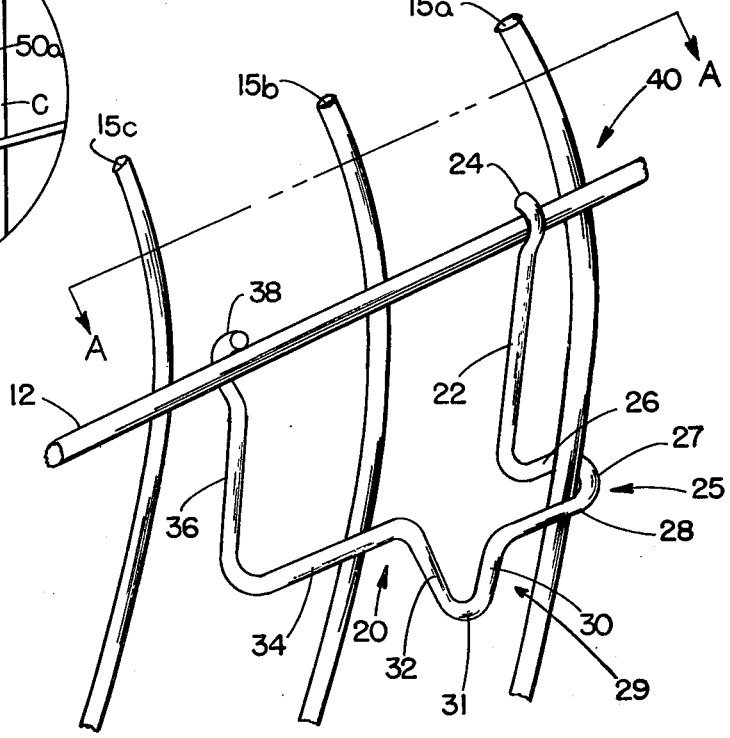
FIG. 2 is a perspective view of one spacer mounted on the wire fabric.

Reinforcement spacer 20, as shown in FIGS. 2, 3, 4, and 5 is made of a single piece of wire shaped to form the spacer portion 29 comprising a U-shaped contact segment 31, which contacts form inner wall 41, and spacer legs 30 and 32, extending away from either end thereof. Legs 30 and 32 flare slightly away from each other to increase the strength of spacer portion 29, with respect to lateral bending forces, when same is in contact with a conrete form as described below. For purposes of illustration only, it will be presumed that leg 32, as viewed in FIG. 2, is generally vertical and spacer portion 29 opens downwardly.

The wire cage engaging or positioning part 25 which has the function of positioning and orienting the spacer on the wire fabric cage 40, is integrally joined to leg 30 of spacer portion 29. Part 25, also in "U"-shaped configuration, includes legs 28 and 26 connected together by the bight 27. Leg 28 extends horizontally to the right from leg 30, as viewed in FIG. 2, and leg 26 extends in the reverse direction because of the bight 27 so that the part 25 engages and fits around cage wire 15*a*. Part 25 and spacer 29 lie generally in a common vertical plane.

Extending from the end of leg 26 is clip arm 22, which extends perpendicular to the plane of the wire-engaging part 25. A downwardly facing hook or detent 24 is integrally formed on the free end of upper clip arm 22 and hooks about wire 12 as will be explained hereinafter. The width of hook or detent 24 is selected to accommodate a variety of different diameter transverse wires.

Figure 5:
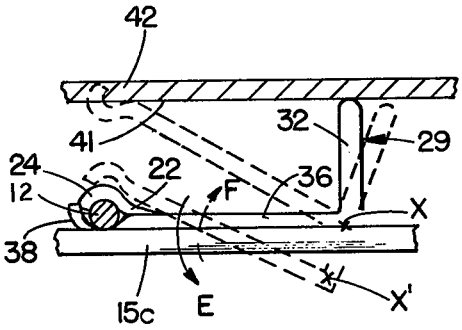
FIG. 5 is an end elevational view of the spacer and fabric looking in the direction of arrows B—B in FIG. 2 and showing in phantom the shape of the spacer when unmounted.
Figure 6:
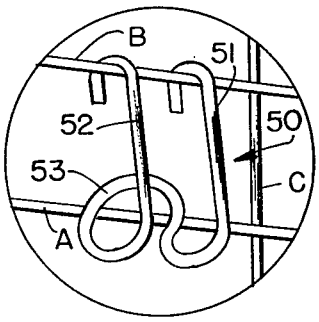
FIG. 6 (PRIOR ART)
FIG. 6 is a perspective view of a prior art reinforcement spacer.
Figure 7:
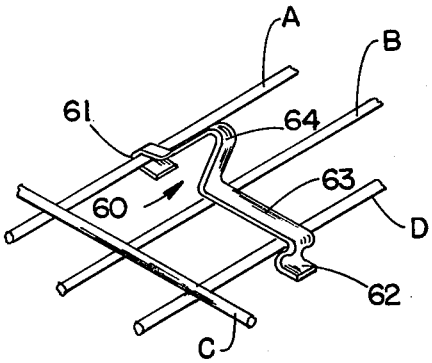
FIG. 7 (PRIOR ART)
FIG. 7 is a perspective view of another prior art spacer.
Figure 8:
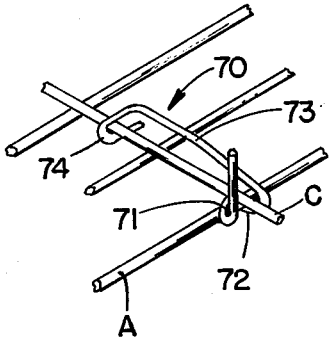
FIG. 8 (PRIOR ART)
FIG. 8 is a perspective view of yet another prior art spacer.

Extending to the right from and connected to leg 32 of the spacer portion 29 is torsion bar 34 on the end of which extends another clip arm 36. Clip arm 36 extends perpendicularly from torsion bar 34 and when unmounted on cage 40, is generally parallel to clip arm 22 (FIG. 5). A hook or detent 38 is integrally formed on the free end of lower clip arm 36 and fits about the same wire 12 as hook 24. The interior width of hook 38 is generally the same as the width of hook 24.

FIG. 2 shows spacer 20 mounted on a section of wire cage 40 comprising the generally parallel wires 15 joined to a wire 12. Spacer 20 is mounted on the wire fabric of cage 40 by first placing wire engaging part 25 around a first wire 15*a* with leg 26 positioned under and leg 28 positioned over first wire 15*a* and with the bight 27 extending around first wire 15*a*. In this position, torsion bar 34 abuts against the next adjacent wire 15*b*. Clip arm 22 is then rotated upwardly so that hook 24 is hooked over the upper surface of wire 12. With the torsion bar 34 abutting against the next adjacent wire 15*b*, clip arm 36 is rotated downwardly about the axis of torsion bar 34 and hook 38 is snapped into position on the underside of wire 12. When so mounted, torsion bar 34 is restrained by wire 15*b* and the torsion in bar 34 along with a minor amount of torsion in leg 26 causes leg 26 of wire engaging part 25 to press upwardly against first wire 15*a* and be held in place. Clip arms 22 and 36 are biased in opposite directions due to the torsional force in torsion bar 34 and leg 26 created by rotating clip arms 22 and 36 about the axis of leg 26 and torsion bar 34. Before cage 40 is mounted inside the form 42 with the spacers in place as disclosed by FIG. 1, spacers 20 are mounted thereon at strategic positions. Cage 40 is then inserted within form 42 so that each of content segments 31 of each spacer engage the interior surface of form 42. When assembled in this manner, cage 40 is properly spaced from form 42. Finally, a packer head (not shown) packs concrete (not shown) around cage 40 so as to form a section of concrete pipe.

Figure 9:
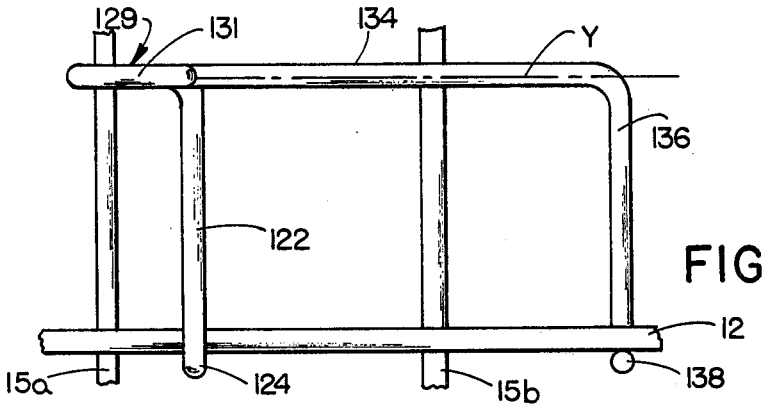
FIG. 9 is a plan view of an alternative embodiment of the spacer of this invention.
Figure 10:
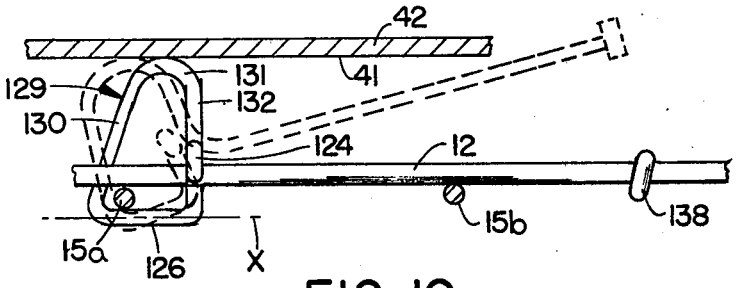
FIG. 10 is a side elevational view of the alternative embodiment of the spacer of FIG. 9 and showing in phantom the shape of the spacer when unmounted.
Figure 11:
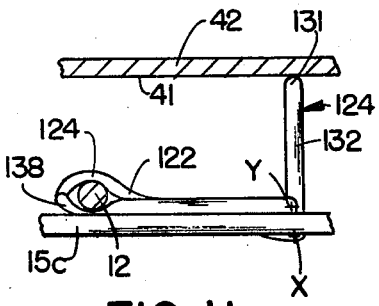
FIG. 11 is a end elevational view of the alternative embodiment of the spacer of FIG. 9.

An alternative embodiment of the reinforcement spacer is shown in FIGS. 9, 10, and 11. The major difference between this embodiment and the previous embodiment is that leg 126 connected to the clip arm 122, which corresponds to clip arm 22 of the first embodiment, extends directly from the spacer leg 130 which corresponds to the spacer leg 30, so that a portion of the wire engaging part, i.e. a wrap around or embracing part, of the first embodment is eliminated. Instead, legs 126 and 130 engage and extend around the circumferential cage wire 15*a* in a generally "L"-shaped manner, rather than an embracing "U"-shaped manner. However, the leg 126, and, to a lesser extent leg 130, still serve a wire engaging and positioning function.

This alternative embodiment is also fabricated from a single piece of wire. U-shaped spacer 129, comprising contact segment 131 and spacer legs 130 and 132 extending from either end thereof, lies in a substantially vertical plane (FIGS. 10 and 11) and opens downwardly. Leg 126 extends inwardly from leg 130 and is substantially horizontal. Clip arm 122 extends generally perpendicular from leg 126 and has a U-shaped hook or detent 124 formed on its free end. Torsion bar 134 extends horizontally inwardly downwardly from leg 132 and terminates at clip arm 136 which extends perpendicularly from torsion bar 134 and is oriented in substantially the same direction as clip arm 122. A U-shaped hook or detent 138 is formed on the free end of lower clip arm 136.

This second embodiment is easier to construct than the previous embodiment but is not as secure as the previous embodiment in which wire engaging part 25 not only engages, but embraces first wire 15.

Figure 12:
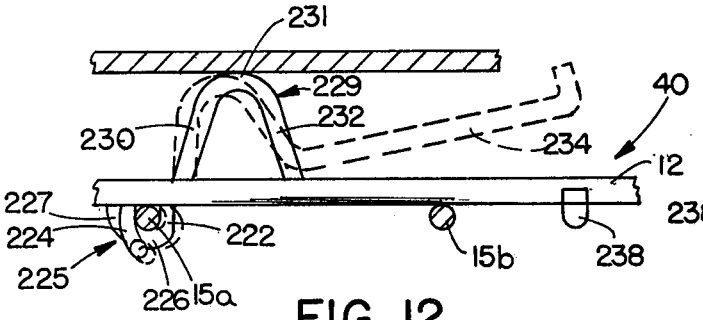
FIG. 12 is a side elevational view of another alternative embodiment of the spacer of this invention and showing in phantom the shape of the spacer when unmounted.
Figure 14:
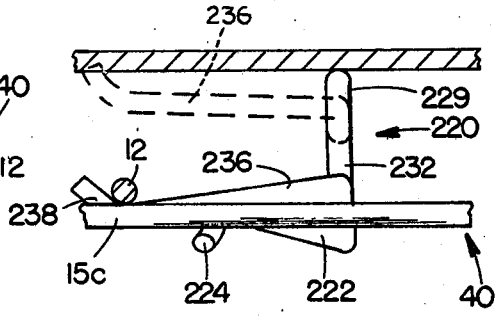
FIG. 14 is an end elevational view of the alternative embodiment of the spacer of FIG. 12.
Figure 13:
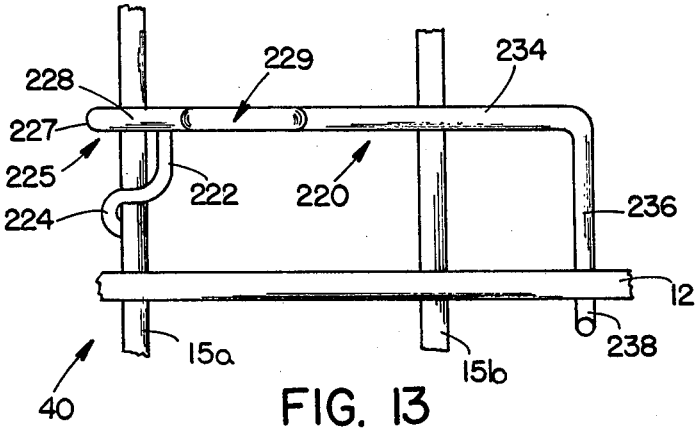
FIG. 13 is a plan view of the alternative embodiment of the spacer of FIG. 12.

Yet another alternative embodiment of the reinforcement spacer 220 is shown in FIGS. 12, 13 and 14. Comparably to the other embodiments, spacer 220 comprises a spacer portion 229 for spacing a reinforcement from a form, a torsion bar portion 234 extending in one direction from spacer portion 229, a wire engaging portion 225 extending in the opposite direction from spacer portion 229, and a pair of spaced clip arms 222 and 236 extending generally perpendicularly from the plane of spacer portion 229, wire engaging portion 225 and torsion bar 234 for clipping over wires of reinforcement 40 to which spacer 220 is to be attached. The major difference between this embodiment and the previous embodiments is that upper clip arm or leg 222 hooks around circumferential wire 15*a* rather than longitudinal wire 12. Consequently, upper clip arm 222 exerts a downward force on circumferential wire 15*a* rather than on longitudinal wire 12 as with the upper clip arms of the previous embodiments. Leg 222 extends generally perpendicularly from wire engaging portion 225. Upper clip arm detent 224 is formed in the terminal portion of arm 222 and, when spacer 220 is mounted on the reinforcement, extends over, around, and then under circumferential wire 15*a*.

Alternative spacer 220 is also fabricated from a single piece of wire. U-shaped spacer portion 229, comprising bight 231 and spacer legs 230 and 232 extending therefrom, lies in a plane generally perpendicular to reinforcement 40 on which reinforcement spacer 220 is mounted. Wire engaging part 225 extends from spacer 229 and passes around circumferential 15*a*. Wire engaging portion 225 is generally "U"-shaped comprising a top leg 228, a bight 227 and a bottom leg 226. Clip arm 222 extends generally perpendicularly from leg 226 of wire engaging portion 225 and terminates in hook 224 which wraps around circumferential 15*a*. Torsion bar 234 extends from spacer 229 in a direction generally opposite that of wire engaging part 225. Bar 234 extends across the next adjacent circumferential 15*b* and terminates at lower clip arm 236 which extends generally perpendicularly from torsion bar 234. Both clip arms 222 and 236 are oriented in substantially the same direction from the remaining portion of the reinforcement spacer 220. A deviation 238 is integrally formed in the free end of clip arm 236 and engages the underside of longitudinal wire 12 as most clearly shown in FIG. 13.

All three described embodiments of the reinforcement spacer are preferably manufactured from a low carbon, bright basic wire. Expensive spring steel is unnecessary because the spacer is mounted using primarily torsional force rather than spring lever force, although some spring force may play a role. Preferably, the diameter of the wire is in the range of 0.133 inch to 0.149 inch. A heavier gauge would be required if upper and lower clip arms were relatively long. In such a case, a diameter of up to 0.160 inch might be required.

OPERATION

In the use and operation of the embodiment of FIGS. 2, 3, 4, and 5, the spacer is mounted on the wire fabric cage 40 by first hooking the U-shaped wire-positioning part 25 around one of the circumferential wires 15*a*. When so hooked around this wire 15*a*, leg 26 and either one or both of the bight 27 and/or leg 28 engage the wire as disclosed in FIG. 2. In this orientation, the torsion bar 34 extends across the next adjacent circumferential wire 15*b* and both of the clip arms 22 and 36 extend substantially perpendicular to the longitudinal wires 12.

The spacer is then slid along the circumferential wire 15 into a position where the clip arm 22 and 36 can be hooked about one of the longitudinal wires 12. As is evident from FIG. 2, the hook 24 of clip arm 22 faces downwardly and the hook 38 of clip arm 36 faces upwardly. In moving the clip arms into hooking position as disclosed in FIG. 2, it is much easier and preferable to place hook 24 over longitudinal 12 first, and then place hook 38 under the same longitudinal wire 12. In this hooking operation, a torsional force is generated by both of the clip arms 22 and 36 within the torsion bar 34, and to some extent in leg 26.

Figure 4:
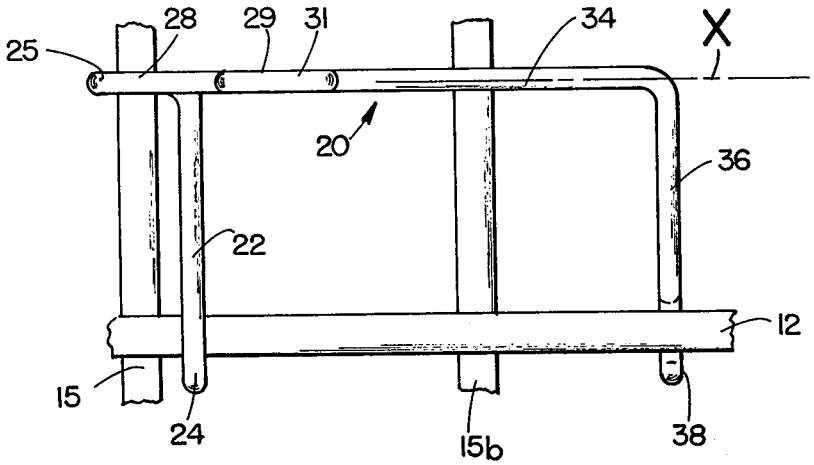
FIG. 4 is a plan view of the spacer and wire fabric of FIG. 2.
Figure 3:
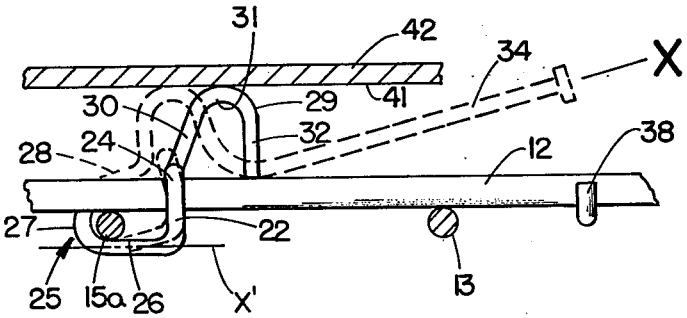
FIG. 3 is a side elevational view of the spacer and wire fabric looking in the direction of arrows A—A in FIG. 2 and showing in phantom the shape of the spacer when unmounted.

As disclosed in FIGS. 3 through 5, the torsional force exerted by the torsion bar 34 is about its axis X, and to a degree some torsion force is generated in leg 26 about the axis $X^1$. Torsion bar 34 is held in position by being forced against circumferential 15*b*. It should be understood that in hooking these two arms 22 and 36 about the wire 12, they are biased in the directions as indicated by the arrows E and F, respectively, of FIG. 5, arm 22 being biased in the direction E and arm 36 in the direction F. Arms 22 and 36 act as torsion generating means, generating torsional force in torsion bar 34 as they are hooked over and under, respectively, wire 12. Thus, it will be seen that there is provided opposite torsional forces which assist in clamping the hooks 24 and 38 which are engaged on opposite sides of the transverse or longitudinal wire 12. It should be understood that the torsional forces generated by the torsion bar 34 and the leg 26 are believed to contribute substantially to the holding or clamping force of the hooks 24 and 38 on the longitudinal wire 12. Further, it is necessary that the torsion bar 34 span or cross an adjacent circumferential wire 15 or otherwise there would be nothing to hold the torsion bar 34 in its desired position. Therefore, there is some holding force generated by the bending of the torsion bar 34 as well as the torsional force generated thereby. Also, it should be realized there is also some holding force contributed by the bending forces generated by the clip arms 22 and 36.

In the embodiment of FIGS. 9, 10 and 11, the mounting of the spacer is very similar to that above described. In this mounting procedure, the legs 126 and 130 are hooked about a circumferential wire, such as 15*a* in FIG. 9, with wire 15*a* engaging leg 126 and fitted into the juncture between the legs 126 and 130 so as to also possibly engage the leg 130 as disclosed in FIG. 10. With this orientation of the spacer, the torsion bar 134 crosses an adjacent circumferential wire 15*b*. The spacer is then slid along the wires 15*a* and 15*b* until the hooks 124 and 138 are in position for being hooked about a longitudinal wire, such as 12 in FIG. 9. The holding forces generated in the spacer for holding it on the wire fabric are substantially the same as previously discussed.

In the embodiment of FIGS. 12, 13 and 14 the mounting of spacer 220 is also somewhat similar to that above described. In mounted spacer 220, legs 226 and 228 are hooked about circumferential wire 15*a* with wire 15*a* fitted into the juncture between legs 226 and 228. Hook 224 is then hooked over circumferential wire 15*a* so that clip arm 222 is positioned generally adjacent wire 15*a* and hook 224 passes around circumferential wire 15*a*. In this orientation of spacer 220, torsion bar 234 crosses the next adjacent circumferential wire 15*b*. Spacer 220, and more particularly positioning part 225 is slid along wires 15*a* and 15*b* until hook 238 is in position to be hooked under longitudinal wire 12. Lower clip arm 236 is then forced downwardly so that hook 238 may be slid under longitudinal wire 12 by sliding torsion bar 234 along circumferential wire 15*b*. Although hook 224 engages a circumferential rather than a longitudinal wire, the holding forces generated in spacer 220 are substantially the same as previously described.

It should be understood that as disclosed in FIG. 1 a number of the spacers are located on the cage 40 at strategic points so that the U-shaped spacer segments 29 all extend radially outwardly from the cage 40. Then, as previously described, the cage is inserted in a form such as form 42 and the concrete is packed about the cage to form the reinforced concrete pipe.

Of course it is understood that the above are merely preferred embodiments of the invention and that various changes and alterations can be made without departing from the spirit and broader aspects of the invention as set forth in the appended claims which are to be interpreted in accordance with the principles of patent law including the doctrine of equivalents.

The embodiments of the invention in which an exclusive property or privilege is claimed are defined as follows:

1. A spacer for use with a wire reinforcement in the manufacture of wire reinforced concrete articles, said reinforcement including a plurality of spaced first set wires joined to a plurality of spaced second set wires oriented generally laterally to said first set wires, said spacer comprising:

torsion means for storing a torsion force exerted thereon;

a spacer portion extending away from said torsion means; and torsional force generating means operably connected to said torsion means for engaging said reinforcement and for generating a torsion holding force within said torsion means for assisting in holding the spacer on said wire reinforcement.

2. The spacer of claim 1 in which said torsional force generating means engage opposite sides of said reinforcement whereby said spacer is clamped onto said reinforcement by said torsion means acting on said torsional force generating means.

3. The spacer of claim 2 which is formed of a single piece of wire.

4. The spacer of claim 1, 2 or 3 further comprising positioning means operably connected to said torsion means and shaped to engage one of said first set wires in said wire reinforcement for assisting in positioning, orienting, and holding said spacer on said wire reinforcement.

5. The spacer of claim 4 wherein said torsion means is sufficiently long to extend from said positioning means over the next adjacent first set wire when said spacer is installed on said reinforcement; said torsional force generating means comprising a pair of arms formed on the ends of said spacer and spaced one from the other, said arms extending from said torsion means and said positioning means, respectively, in generally the same direction and having hooks on the ends thereof for hooking about one of said second set wires, at least one of said arms when in hooked position generating said torsional holding force in said torsion means.

6. The spacer of claim 5 in which one of said arms is adapted to hook over one side one of said second set wire and the other is adapted to hook over the other side of said one second set wire.

7. The spacer of claim 6 wherein said spacer portion is generally U-shaped and generally perpendicular to said arms.

8. The spacer of claim 7 wherein said spacer portion is adjacent said positioning means.

9. The spacer of claim 6 wherein said positioning means is generally U-shaped having first and second legs, said first leg abutting said one first set wire and said second leg located on the opposite side of said one first set wire from said first leg.

10. The spacer of claim 4 wherein said torsion means is sufficiently long to extend from said positioning means over the next adjacent first set wire when said spacer is installed on said reinforcement, said torsional force generating means comprising first and second arms formed on the ends of said spacer and spaced one from the other, said first and second arms extending from said torsion means and said positioning means, respectively, in generally the same direction, one of said first and second arms having a first hook on the end thereof adapted for hooking about one of said second set wires, the other of said first and second arms having a second hook on the end thereof adapted for hooking about one of said first set wires, at least one of said arms when in hooked position generating said torsional holding force in said torsion means.

11. The spacer of claim 10 wherein one of said arms is adapted to hook over one side of said reinforcement and the other is adapted to hook over the other side of said reinforcement.

12. The spacer of claim 11 wherein said spacer portion is generally U-shaped and generally perpendicular to said arms.

13. The spacer of claim 12 wherein said spacer portion is adajacent said positioning means.

14. The spacer of claim 11 wherein said positioning means is generally U-shaped having first and second legs, said first leg abutting said one first set wire and said second leg located on the opposite side of said one first set wire from said first leg.

15. A spacer for use with wire reinforcement in the manufacture of wire reinforced concrete articles, said wire reinforcement comprising a plurality of first set wires running in one direction and a plurality of second set wires crossing said first set wires, said spacer comprising:

a generally U-shaped spacer portion having first and second legs;

a torsion bar joined to the first leg of said spacer portion, and oriented in a first direction;

a first clip arm joined to the end of said torsion bar opposite to said first leg and oriented in a second direction;

a positioning means joined to said second leg of said spacer portion and oriented in a third direction generally opposite to said first direction, said positioning means adapted to engage said wire reinforcement for positioning said spacer on said wire reinforcement; and a second clip arm joined to said positioning means and extending generally in said second direction generally parallel to said first clip arm.

16. The spacer of claim 15 including:

a first hook portion located on the end of said first clip arm; and a second hook portion located on the end of said second clip arm.

17. The reinforcement spacer of claim 15 or 16 wherein said first and third directions are generally perpendicular to said second direction.

18. The reinforcement spacer of claim 17 wherein said first and second hook means engage opposite sides of said wire reinforcement.

19. A concrete reinforcement assembly including a wire reinforcement having first set wires oriented generally laterally to second set wires, and means for spacing said wire reinforcement from a concrete form, wherein the improvement comprises said spacing means including a plurality of spacers each comprising:

a generally U-shaped spacer portion having first and second legs;

a torsion bar joined to the first leg of said spacer portion, and oriented in a first direction, at least a part of said torsion bar extending across one of said first set wires;

a first clip arm joined to the end of said torsion bar opposite to said first leg, oriented in a second direction, and engaging one side of one of said second set wires;

positioning means joined to said second leg of said spacer portion and oriented in a third direction generally opposite to said first direction, said positioning means adapted to extend about another of said first set wires for positioning said spacer on said wire reinforcement; and a second clip arm joined to said positioning means and extending generally in said second direction generally parallel to said first clip arm and engaging the other side of said one second set wire.

20. The assembly of claim 19 comprising:

a first hook portion located on the end of said first clip arm, said first hook portion engaging said one side of said one second set wire; and a second hook portion located on the end of said second clip arm, said second hook portion engaging said other side of said one second set wire.

21. The assembly of claim 20 wherein said first and third directions are generally perpendicular to said second direction.

22. A concrete reinforcement assembly including a wire reinforcement having first set wires oriented generally laterally to second set wires, and means for spacing said wire reinforcement from a concrete form, wherein the improvement comprises said spacing means including a plurality of spacers each comprising:

a generally U-shaped spacer portion having first and second legs;

a torsion bar joined to the first leg of said spacer portion, and oriented in a first direction, at least a part of said torsion bar extending across one of said first set wires;

a first clip arm joined to the end of said torsion bar opposite to said first leg and oriented in a second direction;

positioning means joined to said second leg of said spacer portion and oriented in a third direction generally opposite to said first direction, said positioning means adapted to extend about another of said first set wires for positioning said spacer on said wire reinforcement; and a second clip arm joined to said positioning means and extending generally in said second direction generally parallel to said first clip arm; said first clip arm engaging one side of said wire reinforcement and said second clip arm engaging the other side of said wire reinforcement.

23. The assembly of claim 22 comprising:

a first hook portion located on the end of said first clip arm, said first hook portion hooked against a second set wire; and a second hook portion located on the end of said second clip arm, said second hook portion hooked against a first set wire.

24. The assembly of claim 23 wherein said first and third directions are generally perpendicular to said second direction.

25. A concrete reinforcement assembly including a wire reinforcement having a plurality of spaced first set wires and a plurality of spaced second set wires crossing said first set wires, and means for spacing said wire reinforcement from a concrete form, wherein the improvement comprises said spacing means including a plurality of spacers each comprising:

torsion means for storing a torsion force exerted thereon;

a spacer portion extending away from said torsion means; and torsional force generating means operably connected to said torsion means for generating a torsion holding force within the torsion means for assisting in holding said spacer on said wire reinforcement.

26. The assembly of claim 25 in which said torsional force generating means engage opposite sides of said wire reinforcement whereby said spacer is clamped onto said fabric by said torsion means acting on said torsion force generating means.

27. The assembly of claim 26 in which said spacer is formed of a single piece of wire.

28. The assembly of claim 26 or 27 in which said spacer comprises positioning means operably connected to said torsion means and engaging one of said first set wires for assisting in positioning, orienting, and holding said spacer on said wire reinforcement.

29. The assembly of claim 28 wherein said torsion means extends from said positioning means over the next adjacent first set wire; said torsional force generating means comprising a pair of arms formed on the ends of said spacer and spaced one from the other, said arms extending from said torsion means and positioning means, respectively, in generally the same direction and having hooks on the ends thereof hooked about one of said second set wires, at least one of said arms generating said torsional holding force in said torsion means.

30. The assembly of claim 29 in which one of said arms hooks over one side of said one second set wire and the other of said arms hooks over the other side of said second set wire.

31. The assembly of claim 30 wherein said spacer portion is generally U-shaped and generally perpendicular to said arms.

32. The assembly of claim 31 wherein said spacer portion is adjacent said positioning means.

33. The assembly of claim 32 wherein said positioning means is generally U-shaped having first and second legs, said first leg abutting said one first set wire and said second leg located on the opposite side of said one first set wire from said first leg.

34. The assembly of claim 28 wherein said torsion means is sufficiently long to extend from said positioning means over the next adjacent first set wire when said spacer is installed on said reinforcement, said torsional force generating means comprising first and second arms formed on the ends of said spacer and spaced one from the other, said first and second arms extending from said torsion means and said positioning means, respectively, in generally the same direction, said first arm having a first hook on the end thereof for hooking about one of said second set wires, said second arm having a second hook on the end thereof for hooking about a first set wire, at least one of said arms when in hooked position generating said torsional holding force in said torsion means.

35. The spacer of claim 34 wherein one of said arms is adapted to hook over one side of said reinforcement and the other of said arms is adapted to hook over the other side of said reinforcement.

36. The assembly of claim 35 wherein said spacer portion is generally U-shaped and generally perpendicular to said arms.

37. The assembly of claim 36 wherein said spacer portion is adjacent said positioning means.

38. The assembly of claim 37 wherein said positioning means is generally U-shaped having first and second legs, said first leg abutting said one first set wire and said second leg located on the opposite side one of said first set wire from said first leg.

39. A method for spacing concrete reinforcement wire fabric from a form wall, said fabric including a first set of generally parallel wires joined to a second set of generally parallel wires oriented generally laterally with respect to said first set, said method comprising:

providing a spacer including torsion means for storing a torsion force exerted thereon, a spacer portion extending away from said torsion means, and torsional force generating means operably connected to said torsion means for generating a torsion holding force within said torsion means;

positioning a plurality of said spacers throughout said fabric;

engaging opposite sides of said fabric with said torsional force generating means of each said spacer.

40. The method of claim 39 further comprising forming each said spacer of a single piece of wire.

41. The method of claim 39 or 40 further comprising providing said spacer with positioning means operably connected to said torsion means and engaging one of said first set wires for assisting in positioning, orienting, and holding said spacer on said wire reinforcement.

42. The method of claim 41 further comprising extending said torsion means from said positioning means over the next adjacent first set wire;

said step of providing said spacer with said torsional force generating means comprising providing a pair of arms generally at the ends of said spacer and spaced from one another, and extending said arms from said torsion means and from said positioning means, respectively, in generally the same direction; and said step of engaging said opposite sides of said fabric with said torsional force generating means comprising hooking one of said arms about one side of one of said second set wires and hooking the other of said arms about the other side of said one second set wire.

43. The method of claim 42 in which said step of providing said spacer with said spacer portion comprises providing a generally U-shaped portion generally perpendicular to said arms.

44. The method of claim 43 further comprising locating said spacer portion adjacent said positioning means.

45. The method of claim 44 which includes shaping said positioning means into a generally U-shaped configuration having first and second legs; abutting said one first set wire with said first leg and locating said second leg on the opposite side one of said first set wire from said first leg.

46. The method of claim 41 which includes extending said torsion means from said positioning means over the next adjacent first set wire;

said step of providing said spacer with said torsional force generating means comprising providing first and second arms generally at the ends of said spacer and spaced from one another, and extending said first and second arms from said torsion means and from said positioning means, respectively, in generally the same direction; and said step of engaging said opposite sides of said fabric with said torsional force generating means comprising hooking said first arm about a second set wire and hooking said second arm about said one first set wire.

47. The method of claim 46 in which said step of providing said spacer with said spacer portion comprises providing a generally U-shaped portion generally perpendicular to said arms.

48. The method of claim 47 further comprising locating said spacer portion adjacent said positioning means.

49. The method of claim 48 which includes shaping said positioning means into a generally U-shaped configuration having first and second legs, and abutting said one first set wire with said first leg and locating said second leg on the opposite side one of said first set wire from said first leg.

* * * * *

UNITED STATES PATENT AND TRADEMARK OFFICE

CERTIFICATE OF CORRECTION

PATENT NO. : 4,452,026

DATED : June 5, 1984

INVENTOR(S) : Wilbur E. Tolliver

It is certified that error appears in the above-identified patent and that said Letters Patent is hereby corrected as shown below:

Abstract, line 13:
"the hold" should be --to hold--;

Column 2, line 9:
"3,722,614" should be --3,722,164--;

Column 3, line 59:
"form" should be --wall form--;

Column 5, line 33:
"content" should be --contact--;

Column 5, line 59:
"perpendicular" should be --perpendicularly--;

Column 8, line 68:
"side one of said" should be --side of said one--;

Column 12, line 24:
"side one of said" should be --side of said one--;

Column 13, line 7:
"side one of said" should be --side of said one--; and

UNITED STATES PATENT AND TRADEMARK OFFICE

CERTIFICATE OF CORRECTION

PATENT NO. : 4,452,026

DATED : June 5, 1984

INVENTOR(S) : Wilbur E. Tolliver

It is certified that error appears in the above-identified patent and that said Letters Patent is hereby corrected as shown below:

Column 14, line 16:
"side one of said" should be --side of said one--.

Signed and Sealed this

*Nineteenth* Day of *February 1985*

[SEAL]

*Attest:*

DONALD J. QUIGG

*Attesting Officer*

*Acting Commissioner of Patents and Trademarks*